US008127546B2

(12) United States Patent
Park

(10) Patent No.: US 8,127,546 B2
(45) Date of Patent: Mar. 6, 2012

(54) TURBINE ENGINE FUEL INJECTOR WITH HELMHOLTZ RESONATORS

(75) Inventor: Roger James Park, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 1112 days.

(21) Appl. No.: 11/806,373

(22) Filed: May 31, 2007

(65) Prior Publication Data

US 2008/0295519 A1 Dec. 4, 2008

(51) Int. Cl.
*F02C 7/24* (2006.01)

(52) U.S. Cl. ..... 60/725; 60/425; 431/114; 181/213

(58) Field of Classification Search ..... 60/740, 60/725, 425; 431/114
See application file for complete search history.

(56) References Cited

U.S. PATENT DOCUMENTS

| | | | | |
|---|---|---|---|---|
| 3,437,173 | A | 4/1969 | Ehrich | |
| 4,122,674 | A | 10/1978 | Andersson et al. | |
| 4,409,787 | A | 10/1983 | Davi et al. | |
| 5,343,697 | A | 9/1994 | Johnson et al. | |
| 5,417,056 | A | 5/1995 | Johnson et al. | |
| 5,431,018 | A | 7/1995 | Keller | |
| 5,487,274 | A | 1/1996 | Gulati et al. | |
| 5,534,237 | A | 7/1996 | Yoshida et al. | |
| 5,644,918 | A | 7/1997 | Gulati et al. | |
| 5,685,157 | A | 11/1997 | Pandalai et al. | |
| 6,351,947 | B1 | 3/2002 | Keller et al. | |
| 6,370,879 | B1 | 4/2002 | Stalder et al. | |
| 6,430,933 | B1 | 8/2002 | Keller | |
| 6,490,864 | B1 | 12/2002 | Joos et al. | |
| 6,546,729 | B2 | 4/2003 | Hellat et al. | |
| 6,981,358 | B2 * | 1/2006 | Bellucci et al. | 60/39.17 |
| 2005/0103018 | A1 | 5/2005 | Graf et al. | |
| 2005/0106519 | A1 | 5/2005 | Flohr et al. | |
| 2005/0229581 | A1 | 10/2005 | Bellucci et al. | |
| 2006/0000220 | A1 * | 1/2006 | Sattinger | 60/776 |
| 2008/0066720 | A1 * | 3/2008 | Piper et al. | 123/470 |

OTHER PUBLICATIONS

Y.Y. Lee, H.Y. Sun, X. Guo, Effects of the Panel and Helmholtz Resonances on a Micro-Perforated Absorber, Int. J. of Appl. Math and Mech., 2005, pp. 49-54, vol. 4.

* cited by examiner

*Primary Examiner* — Ehud Gartenberg
*Assistant Examiner* — Craig Kim
(74) *Attorney, Agent, or Firm* — Finnegan, Henderson, Farabow, Garrett & Dunner LLP

(57) ABSTRACT

An end cap for a fuel injector of a turbine engine is disclosed. The end cap includes an annular first surface including a plurality of perforations. The annular first surface is exposed to a combustion chamber of the turbine engine. The end cap is coupled to an end face of the fuel injector to define an enclosed cavity. The enclosed cavity and the plurality of perforations form an array of Helmholtz resonators.

23 Claims, 6 Drawing Sheets

TURBINE ENGINE FUEL INJECTOR WITH HELMHOLTZ RESONATORS

TECHNICAL FIELD

The present disclosure relates generally to a fuel injector, and more particularly, to a fuel injector with Helmholtz resonators for use with a gas turbine engine.

BACKGROUND

In combustion chambers of turbine engines, pressure or acoustic vibrations can occur during the combustion process under certain conditions. The vibrations may range in frequencies from about twenty hertz to a few thousand hertz, and may occur due to instabilities in the combustion process. The lower frequency acoustic vibrations are sometimes referred to as "rumble" or "chugging." Acoustic vibrations having frequencies higher than about 1000 hertz are typically referred to as "screech." Screech has been found to interfere with optimal operation of the turbine engine. Once screech occurs, it can continue until the source of energy causing the screech is removed, or until system variables are changed, to shift the operation of the turbine engine to a non-screech operational range. However, changing the operational characteristics of the turbine engine to eliminate screech may be difficult. Since the mechanics of how the operational characteristics interact to produce screech is only minimally understood, it is extremely difficult to predict screech in a system with sufficient accuracy. Therefore, a positive structural means is often designed into the combustion chamber to damp the high frequency vibrations or cancel them out completely. One structural element which may be included in the combustion chambers to reduce screech of turbine engines is called a Helmholtz resonator.

A Helmholtz resonator is based on a device created by Hermann von Helmholtz in the 1860s, and works on the phenomenon of air resonance within a cavity. A Helmholtz resonator, in its simplest form, consists of an enclosed volume (cavity) containing air connected to the combustion chamber with an opening. Due to a pressure wave resulting from the combustion process, air is forced into the cavity increasing the pressure within. Once the external driver that forced the air into the cavity is gone, the higher pressure in the cavity will push a small volume of air (plug of air) near the opening back into the combustion chamber to equalize the pressure. However, the inertia of the moving plug of air will force the plug into the combustion chamber by a small additional distance (beyond that needed to equalize the pressure), thereby rarifying the air inside the cavity. The low pressure within the cavity will now suck the plug of air back into the cavity, thereby increasing the pressure within the cavity again. Thus, the plug of air vibrates like a mass on a spring due to the springiness of the air inside the cavity. The magnitude of this vibrating plug of air progressively decreases due to damping and frictional losses. The energy of the pressure wave generated within the combustion chamber is thus dissipated by resonance within the Helmholtz resonator. Energy dissipation is optimized by matching the resonance frequency of the resonator to the acoustic mode, of the combustion chamber enclosure, that is being excited. Typically, frequency matching, or "tuning," of a Helmholtz resonator is accomplished by changing the dimensions of the Helmholtz cavity and opening.

An array of Helmholtz resonators is usually constructed using an empty space between interior and exterior liners of a double dome combustion chamber (combustor). At this location, the Helmholtz resonators are close to a heat release zone of the combustion chamber that creates the instabilities and are, therefore, suitably positioned to quickly respond to the resulting acoustic waves. However, in most combustion chambers, the space between the liners is also used to supply cooling air to the combustion chamber walls, and placing the Helmholtz resonators in this space makes them a part of a cooling system. Helmholtz resonators being a part of the cooling system, however, reduces the ability to tune the Helmholtz resonators by changing the cavity and opening dimensions, without impacting cooling of the combustion chamber. This limitation reduces the effectiveness of the Helmholtz resonators in controlling screech. It is therefore desirable to locate the Helmholtz resonators close to the heat release zone, but independent of the combustion chamber cooling system.

One implementation of a Helmholtz resonator in a gas turbine combustion chamber is described in U.S. Pat. No. 5,431,018 (the '018 patent) issued to Keller on Jul. 11, 1995. The Helmholtz resonator of the '018 patent is disposed around an air shroud that feeds the air necessary for mixing with fuel. Part of the air from the air shroud is bypassed into the Helmholtz resonator using an inlet tube. The Helmholtz resonator is connected to a combustion chamber using a damping tube that is configured as an annular duct around the air shroud. The '018 patent, thus, discloses a single Helmholtz resonator that is formed by a cavity around each fuel injector and connected to the combustion chamber by an annular opening around the injector while being independent of a combustion chamber cooling system of the combustion chamber.

Although the Helmholtz resonator of the '018 patent may be disassociated from the combustion chamber cooling system, it may be associated with the fuel injector air flow. Therefore, varying air flow through the fuel injector in response to changing output requirements of the turbine engine may affect the effectiveness of this resonator. In addition, tuning the resonator of the '018 patent to match the natural frequency of the turbine engine may involve redesigning the annular duct and/or the fuel injector. Typically, tuning the Helmholtz resonator to the appropriate frequency is a trial-and-error process that may involve experiments using a number of configurations (cavity volume, size of the opening that connects the cavity to the combustion chamber, etc.) of the resonator. Thus, it may be advantageous to have the ability to easily test different resonator configurations during development of the system.

The present disclosure is directed at overcoming one or more of the shortcomings set forth above.

SUMMARY OF THE INVENTION

In one aspect, an end cap is disclosed. The end cap includes a first section, a second section, and a third section. The first section has an annular ring with a central axis and a substantially rectangular cross section. The second section is located radially outward of the first section. The second section is integral with, and extends perpendicularly from the first section. The second section has an annular ring aligned with the central axis. The second section has a substantially rectangular cross section with a first width measured parallel to the central axis and a first thickness measured perpendicular to the central axis. The third section is located radially inward of the first section. The third section is integral with and extends perpendicularly from the first section in the same direction as the second section. The third section has an annular ring aligned with the central axis. The third section has a substantially rectangular cross section with a second width measured parallel to the central axis and a second thickness measured perpendicular to the central axis. The end cap also includes a plurality of perforations extending through the first section. The plurality of perforations are disposed in a substantially circular array pattern around the central axis. Each of the plurality of perforations has a substantially circular shape with a generally constant diameter. Angular spacing between any two adjacent perforations of the plurality of perforations is substantially the same, and less than or equal to about 45 degrees.

In another aspect, a method of operating a turbine engine is disclosed. The method includes mixing fuel with air, directing the fuel air mixture through an injector into a combustion chamber, and combusting the fuel air mixture within the combustion chamber to create a pressure wave. The method further includes damping the pressure wave using an array of Helmholtz resonators located at an end face of the injector.

In another aspect, a fuel injector for a turbine engine is disclosed. The fuel injector includes a body member having a longitudinal axis, and a barrel member located radially outwards from the body member. The barrel member includes an end face exposed to a combustion chamber of the turbine engine. The fuel injector also includes an end cap coupled to the barrel member. The end cap and the end face form an array of Helmholtz resonators.

In yet another aspect, an end cap for a fuel injector of a turbine engine is disclosed. The end cap includes an annular first surface including a plurality of perforations. The annular first surface is exposed to a combustion chamber of the turbine engine. The end cap is configured to couple to an end face of the fuel injector to define an enclosed cavity, wherein the enclosed cavity and the plurality of perforations form an array of Helmholtz resonators.

In a further aspect, a component for a fuel injector of a turbine engine is disclosed. The component has a longitudinal axis and a barrel member located radially outwards the longitudinal axis. The barrel member includes an end face exposed to a combustion chamber of the turbine engine. The component also includes an end cap coupled to the barrel member. The end cap and the end face form an array of Helmholtz resonators. The array of Helmholtz resonators include a plurality of perforations exposed to the combustion chamber. Each of the plurality of perforations includes a central axis substantially parallel to the longitudinal axis.

DETAILED DESCRIPTION

Figure 1:
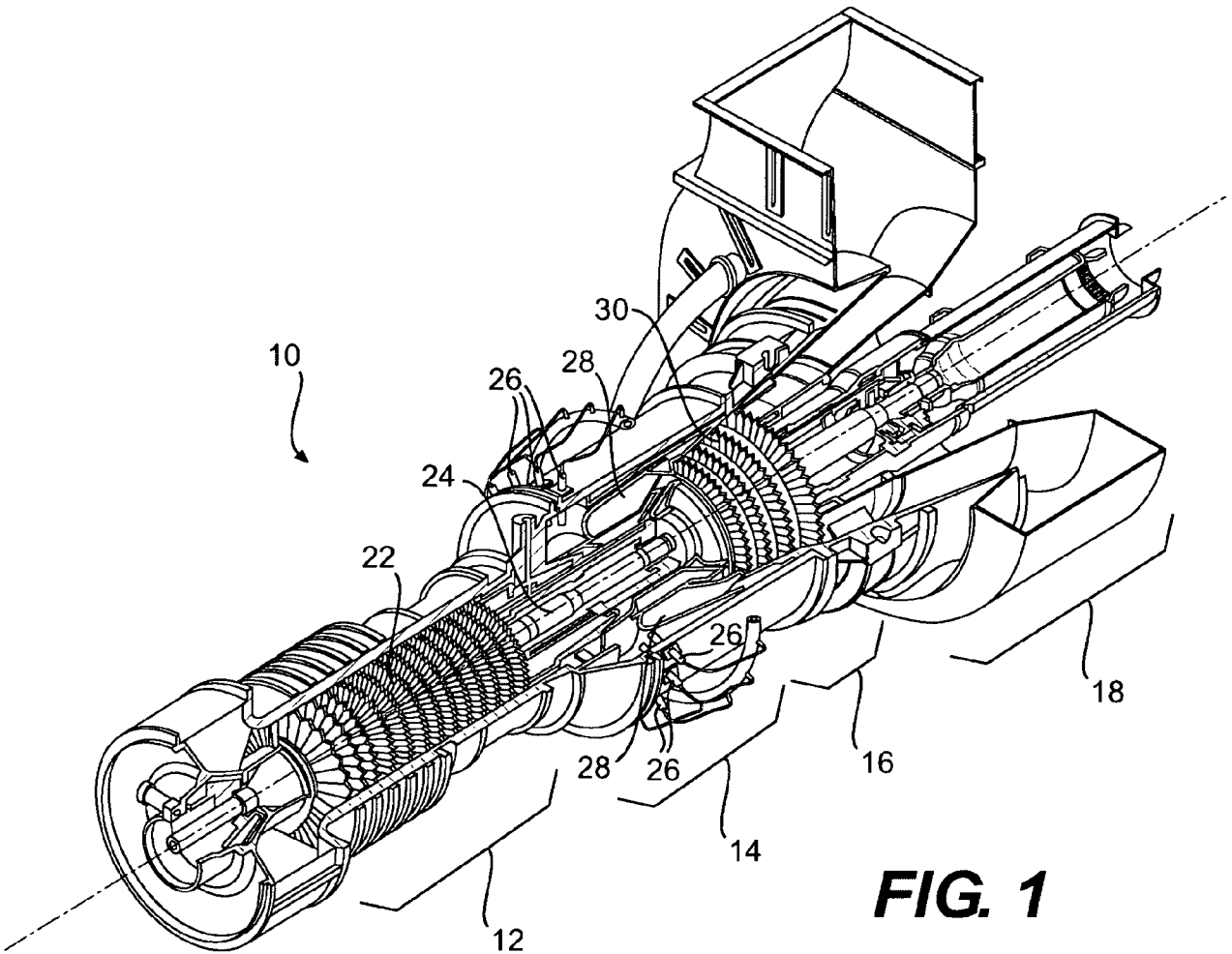
FIG. 1 is a cutaway-view illustration of an exemplary disclosed turbine engine.

FIG. 1 illustrates an exemplary turbine engine 10. Turbine engine 10 may be associated with a stationary or mobile machine. For example, turbine engine 10 may be used to drive a compressor in a gas transport operation, or as a power source for a generator that produces electrical power. Turbine engine 10 may alternatively embody the prime mover of a vehicle. Among other things, turbine engine 10 may include a compressor section 12, a combustor section 14, a turbine section 16, and an exhaust section 18. It should be emphasized that, in this discussion, only those aspects of turbine engine 10 and its components required to illustrate the disclosed fuel injector with Helmholtz resonators will be discussed.

Compressor section 12 may include rotatable components to compress inlet air. Specifically, compressor section 12 may include a series of rotatable compressor blades 22 fixedly connected about a central shaft 24. As central shaft 24 is rotated, compressor blades 22 may draw air into turbine engine 10 and pressurize the air. This pressurized air may then be directed toward combustor section 14 for mixing with a liquid and/or gaseous fuel. It is contemplated that compressor section 12 may further include compressor blades (not shown) that are separate from central shaft 24 and remain stationary during operation of turbine engine 10.

Combustor section 14 may mix fuel with the compressed air from compressor section 12 and combust the mixture. Specifically, combustor section 14 may include a plurality of fuel injectors 26 annularly arranged about central shaft 24, and an annular combustion chamber 28 associated with fuel injectors 26. Each fuel injector 26 may inject liquid and/or gaseous fuel into the flow of compressed air from compressor section 12 for ignition within combustion chamber 28. As the fuel/air mixture combusts, gases within combustion chamber 28 may be heated. These hot gases may then expand and move at high speed into turbine section 16. The hot gases may continue to expand in turbine section 16 and rotate the turbine shaft to produce mechanical power. Although FIG. 1 depicts an annular combustion chamber, embodiments of the disclosure may also be used with other types of combustion chambers, such as, for example, can style combustion chambers.

Figure 2:
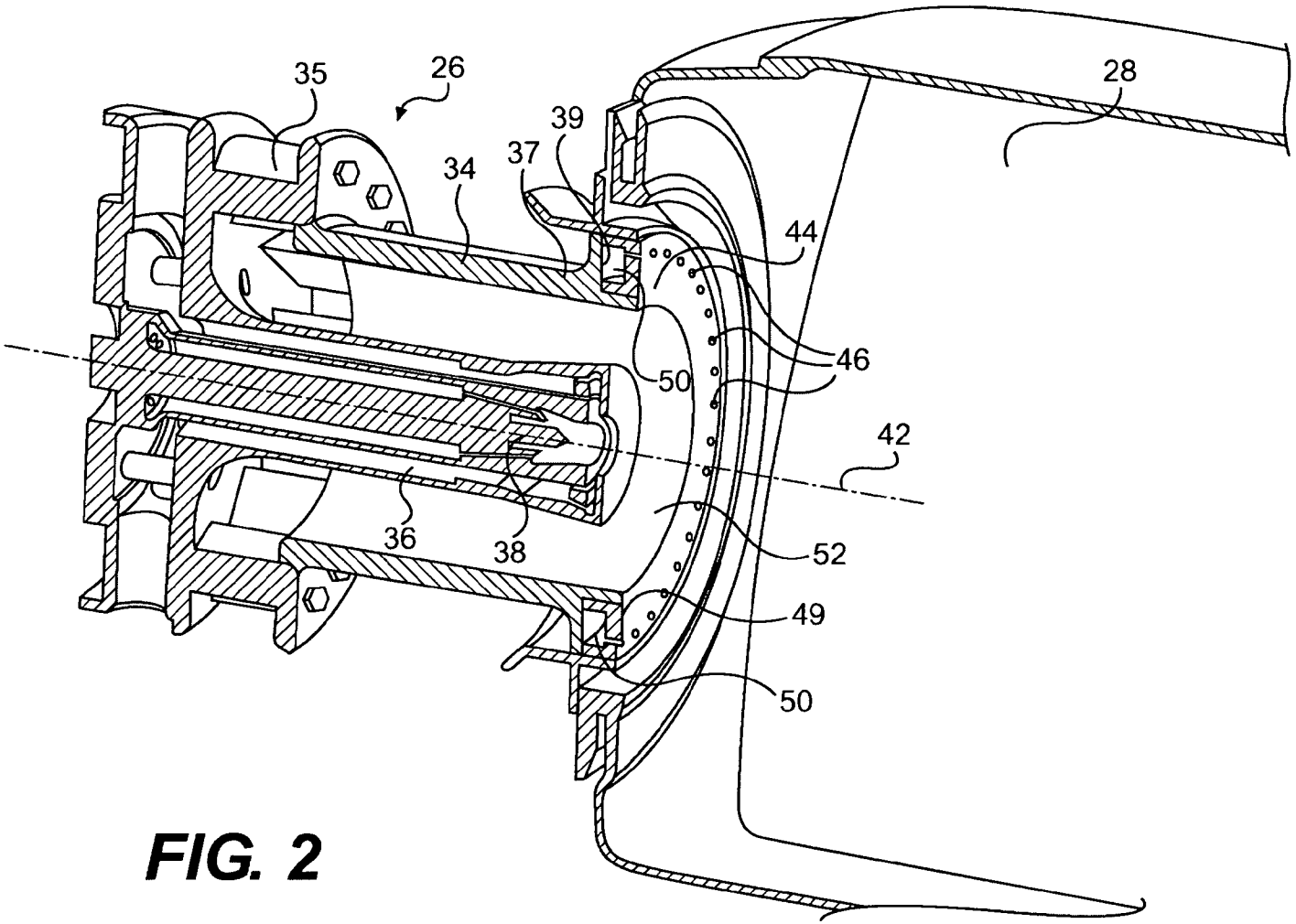
FIG. 2 is a cutaway-view illustration of an exemplary disclosed fuel injector coupled to a combustion chamber of the turbine engine of FIG. 1.

FIG. 2 is a cross-sectional illustration of fuel injector 26 attached to combustion chamber 28. As illustrated in FIG. 2, fuel injector 26 may include components that cooperate to inject gaseous and/or liquid fuel into combustion chamber 28. Specifically, fuel injector 26 may include a barrel housing 34 that may form (or may be connected to) a mixing duct 37 for communication of the fuel/air mixture with combustion chamber 28. Barrel housing 34 may include an end face 39. The end face 39 may be coupled to the combustion chamber 28 such that the central opening 52 fluidly communicates barrel housing 34 with the combustion chamber 28. Fuel injector 26 may also include a central body 36 having, among other components, a pilot fuel injector 38. Central body 36 may be disposed radially inward of barrel housing 34 and aligned along a common axis 42. Pilot fuel injector 38 may be located within central body 36 and configured to inject a stream of pressurized fuel into combustion chamber 28. Air swirler 35 may swirl and direct compressed air from compressor section 12 (shown in FIG. 1) to barrel housing 34. Mixing duct 37 may mix the compressed air with fuel, and direct the fuel/air mixture from fuel injector 26 into combustion chamber 28.

Figure 3:
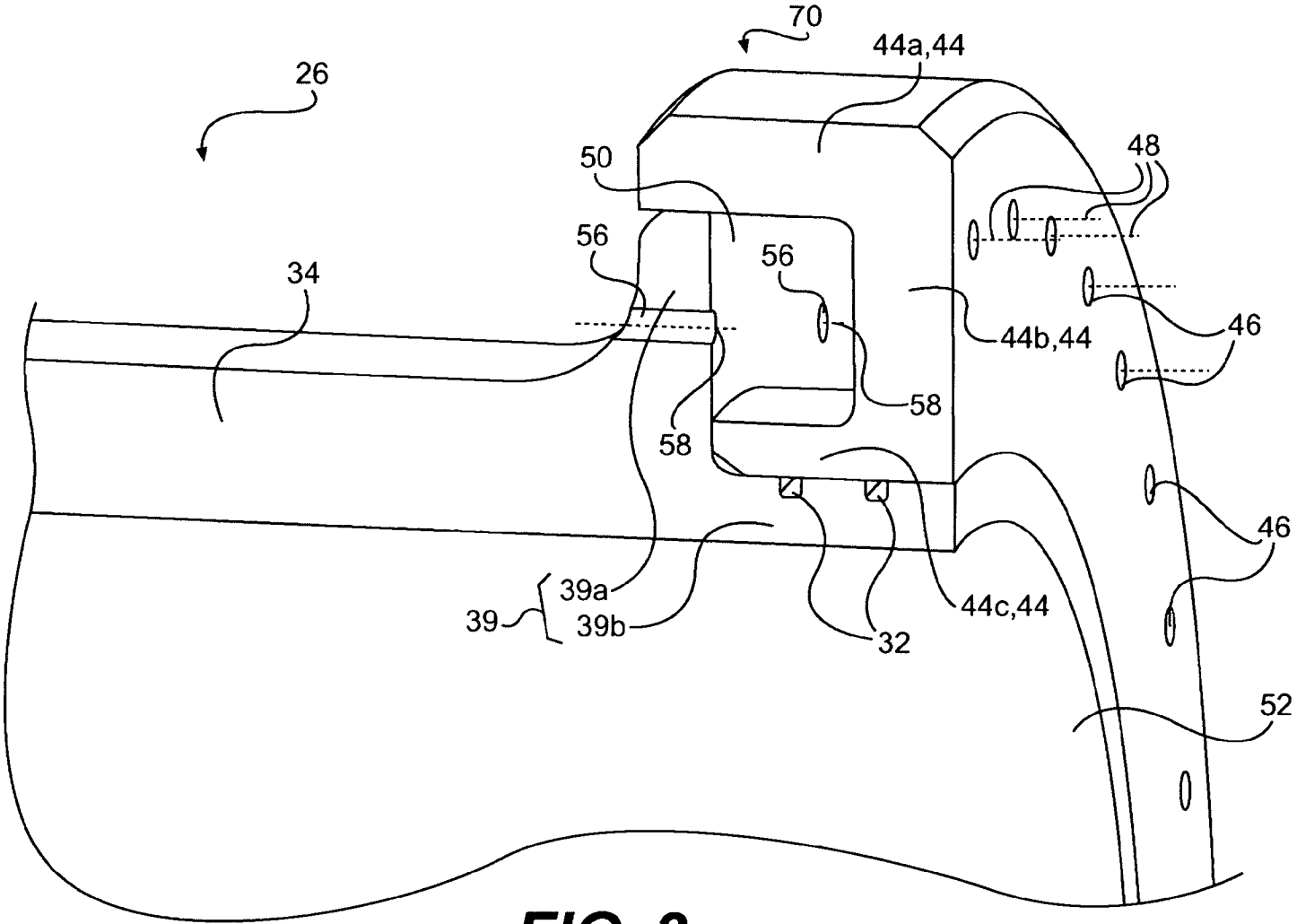
FIG. 3 is a close up cutaway-view of an end cap coupled to an end face of the fuel injector of FIG. 2.

FIG. 3 shows an enlarged section of barrel housing 34, with details of end face 39. In some embodiments, end face 39 may form a stepped section and include a first element 39*a* and a second element 39*b*. In some embodiments, first element 39*a* may be substantially perpendicular to second element 39*b* such that an L-shape is formed in the cross-section of end face 39. However, it is contemplated that first element 39*a* may form any angle with second element 39*b*. It is also contemplated that end face 39 may include additional elements. For example, end face 39 may include an additional element substantially perpendicular to first element 39*a*. In this embodiment, end face 39 may have a cross-section resembling a C-shape.

Figure 4B:
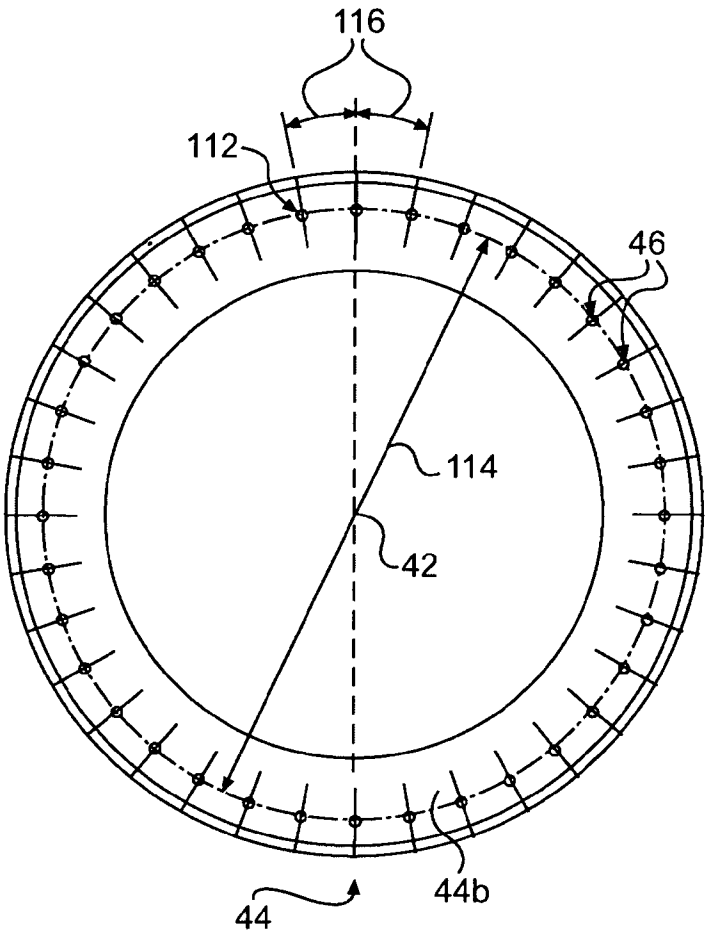
FIG. 4B is an end view of the end cap of FIG. 3.
Figure 4A:
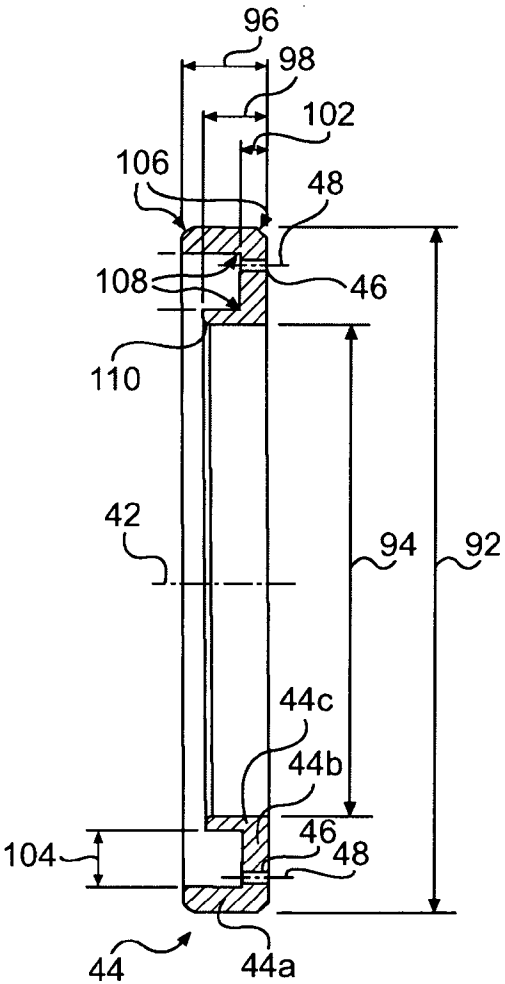
FIG. 4A is a cross-sectional view of the end cap of FIG. 3.

An annular end cap 44 may be coupled to the end face 39. End cap 44 may be made of any material suitable for the application. In some embodiments, end cap 44 may be made of a high strength, nickel based, corrosion resistant alloy, such as, for example, Hastelloy®. FIGS. 4A and 4B show a cross-sectional view and an end view, respectively, of an exemplary end cap 44. End cap 44 may couple with end face 39 and resemble a ring with an outer diameter 92 and an inner diameter 94. Outer diameter 92 and inner diameter 94 can have any value to suit an application. In some embodiments, outer diameter 92 may range in size from about 1 inch to about 6 inches, and inner diameter 94 may range in size from about half an inch to about 5 inches. The cross-sectional view of FIG. 4A may display end cap 44 as having multiple elements, such as for instance, a third element 44*a*, a fourth element 44*b*, and a fifth element 44*c*. In some embodiments, third element 44*a* may be disposed radially outward of fifth element 44*c*, with fourth element 44*b* separating the third and fifth elements 44*a* and 44*c*. In some of these embodiments, third element 44*a* may be substantially parallel to fifth element 44*c* and substantially perpendicular to fourth element 44*b*. In some embodiments, third element 44*a* may have a width 96 that is larger than a width 98 of the fifth element 44*c*. In this embodiment, a width 102 of fourth element 44*b* may be such that a cross-section of end cap 44 may resemble a C-shaped channel with third element 44*a* and fifth element 44*c* forming radially inner and radially outer parallel surfaces and fourth element 44*b* forming a circumferential connector. Third element width 96, fourth element width 102, and fifth element width 98 may all have any value to suit a particular application. It is contemplated that end cap 44 may include a different number of elements and/or that the elements of end cap 44 may be arranged in another manner.

Some or all edges of end cap 44 may be chamfered to reduce stress concentration. The chamfered edges may include flat or curved surfaces to smooth the interface of two surfaces. For example, the outer edge of third element 44*a* may include a first chamfer 106. In another example, an internal edge between third element 44*a* and fourth element 44*b* may include a second chamfer 108. In some embodiments, the internal edge between fourth element 44*b* and fifth element 44*c* may also include second chamfer 108.

End cap 44 may include a plurality of perforations 46 in, for instance, the fourth element 44*b*. These perforations 46 may extend completely through fourth element 44*b*. In a coupled configuration, perforations 46 may be annularly distributed around central opening 52 with a central axis 48 of each perforation 46 being parallel to common axis 42. In some embodiments, perforations 46 and central opening 52 may lie on a common plane generally perpendicular to common axis 42. In some embodiments, perforations 46 may each have a substantially circular shape with a perforation diameter 112, and central axis 48 passing through the center of each perforation 46. These perforations 46 may be annularly distributed on annular fourth element 44*b* in a circular pattern with an array diameter 114, and an angular spacing 116 between any two adjacent perforations being substantially the same. Although perforation diameter 112, array diameter 114, and angular spacing 116 may have any value, in some embodiments, perforation diameter 112 may vary from about 0.005 inches to 0.5 inches, array diameter 114 may vary from about 1 inch to about 5 inches, and angular spacing 116 may vary from about 2 degrees to about 45 degrees. In some embodiments, the plurality of perforations 46 may be formed on end cap 44 by machining. However, it is contemplated than any manufacturing method may be used to create perforations 46.

Figure 5:
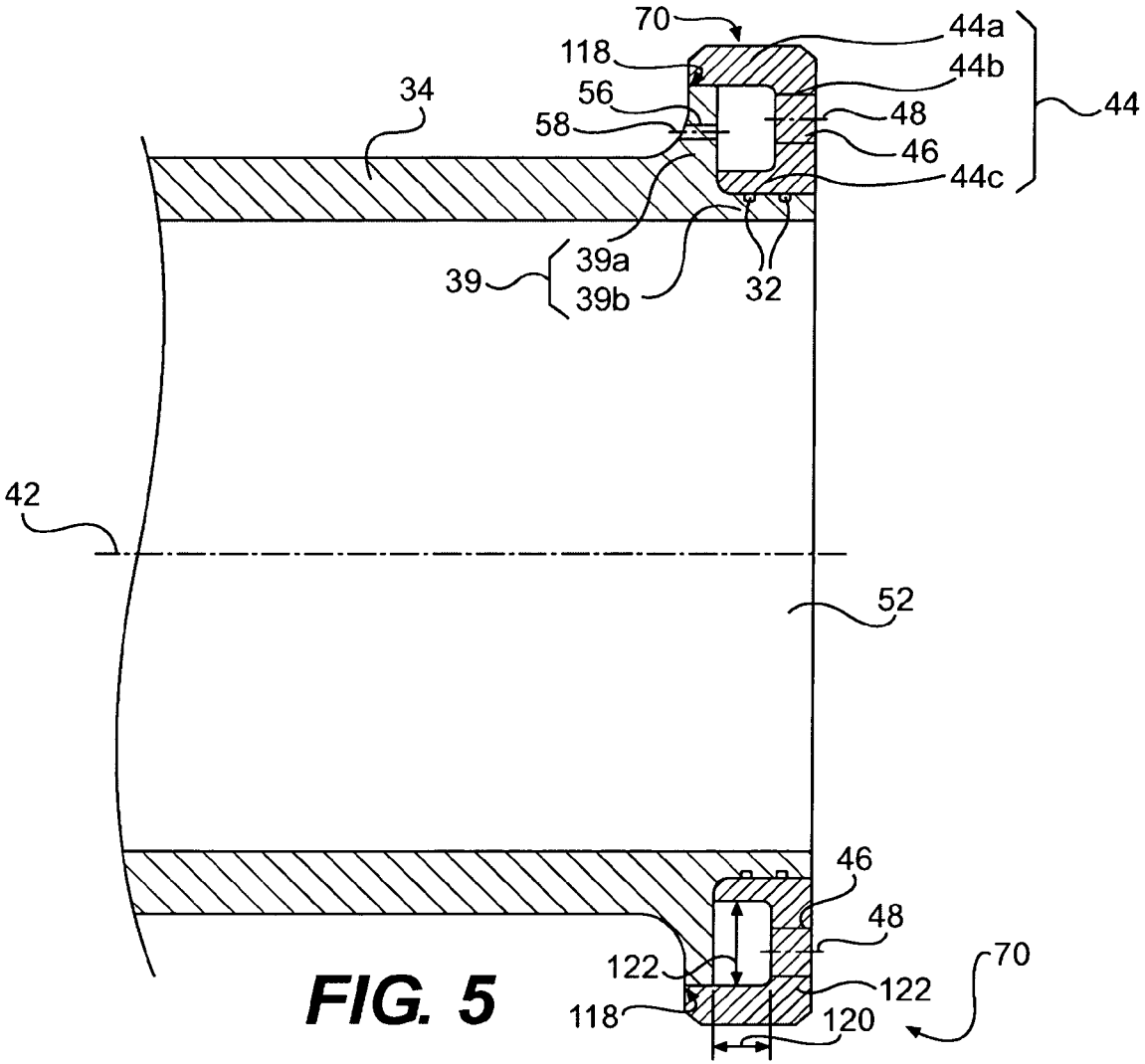
FIG. 5 is a cross-sectional view of the injector of FIG. 3.

FIG. 5 shows a cross-sectional view of end cap 44 coupled to end face 39 of barrel housing 34. In some embodiments, end cap 44 may couple to the end face 39 such that one or more elements of end face 39 and end cap 44 enclose and define hollow cavity 50. That is, the elements of end face 39 and end cap 44 may form the surrounding walls of the hollow cavity 50. In the coupled configuration (as depicted in FIG. 5), third element 44*a* may be disposed radially outward of first element 39*a*; fifth element 44*c* may be disposed parallel to and radially outward of second element 39*b*; and fourth element 44*b* may be parallel to and separated from first element 39*a* of end face 39. In such an embodiment, first element 39*a* and fourth element 44*b* may form opposing walls of cavity 50, and fifth element 44*c* and third element 44*a* may also form opposing walls of cavity 50.

It is contemplated that cavity 50 may be defined differently. For instance, an end cap 44 having only one element may couple with an end face 39 having three elements configured in a generally C-shape to define cavity 50. Similarly, an end cap 44 with two perpendicular elements may couple with an end face 39 also having two opposite perpendicular elements to define cavity 50. It is also contemplated that cavity 50 may be enclosed completely within end cap 44. In this embodiment, end cap 44 may include four elements that enclose and form the boundary walls of hollow annular cavity 50. These additional embodiments are exemplary only and cavity 50 may be defined by end face 39 and end cap 44 in any manner.

Cavity 50 may have any cross-sectional shape and dimension. In some embodiments, cavity 50 may be annularly disposed around common axis 42 and have a rectangular cross section with a cross-sectional width 120 when measured parallel to common axis 42, and a cross-sectional thickness 122 when measured perpendicular to common axis 42. Cross-sectional width 120 and cross-sectional thickness 122 may have any value, and may depend on the dimensions of end face 39 and end cap 44. In some embodiments, cross-sectional width 120 may vary from about 0.05 inches to about 0.5 inches, and cross-sectional thickness may vary from about 0.05 inches to about 1 inch.

In one example application, end cap 44 may have an outer diameter 92 between about 4.0 inches and about 4.2 inches and an inner diameter 94 between about 2.9 inches and about 3.0 inches. For effective screech attenuation in this application, end cap 44 may have a plurality of perforations 46 (on the fourth surface 44*b*) annularly distributed around central axis 42 with an angular spacing 116 between about 9 degrees and about 11 degrees. The perforations may form a circular pattern on the end cap fourth surface 44*b* having an array diameter 114 between about 3.65 inches and about 3.75 inches. The perforation diameter 112 of the each perforation 46 may be between about 0.05 inches and about 0.06 inches. End cap 44 in this application may couple with end face 39 to enclose a cavity 50 having a cross-sectional width 120 between about 0.15 inches and about 0.25 inches and a cross-sectional thickness 122 between about 0.3 inches and about 0.4 inches.

In a second example application, an end cap 44 having an outer diameter 92 between about 4.0 inches and about 4.2 inches and an inner diameter 94 between about 3.0 inches and about 3.5 inches may be coupled with end face 39 to enclose cavity 50. Cavity 50 in the second example application may have a cross-sectional width 120 between about 0.2 inches and about 0.25 inches, and a cross-sectional thickness between about 0.1 inches and about 0.2 inches. For effective screech attenuation in this example, the end cap 44 may also have a plurality of perforations 46 having the same perforation diameter 122, angular spacing 116, and array diameter 114 as that in the previous example.

End cap 44 may be removably or fixedly coupled to end face 39. In some embodiments, end cap 44 may be fixedly coupled to end face 39 using brazing, soldering, or welding. In embodiments where coupling of end cap 44 to end face 39 involves brazing, brazing may be performed using a braze alloy 118 disposed at various locations of an interface between end cap 44 and end face 39. It is contemplated that, in some embodiments, adhesives may be used to couple end cap 44 to end face 39. In some embodiments, end cap 44 may be interference fitted onto or into end face 39. It is also contemplated that end cap 44 may be attached to end face 39 using threaded fasteners. In other embodiments, a mating surface of end cap 44 and end face 39, for example, second element 39*b* and fifth element 44*c*, may be threaded. In these embodiments, the engaged threads may couple these elements together.

One or more surfaces of end face 39 that mate with a surface of end cap 44, for instance second element 39*b*, may include one or more grooves 32 or notches configured to accept O-rings or other sealing members. Although FIG. 5 only shows grooves 32 on second element 39*b*, it is contemplated that other mating surfaces of end face 39 may also have grooves. Alternatively, or additionally, the surfaces of the end cap 44 that mates with surfaces of the end face 39 may also have grooves 32 to accommodate the sealing members. In these embodiments, these sealing members may maintain a substantially air tight seal between the mating surfaces.

First element 39*a* of end face 39 may also include a plurality of purge holes 56. Each purge hole 56 may have a circular cross-sectional shape, with an axis 58 passing through the center thereof. In some embodiments, axis 58 of each purge hole 56 may be parallel to common axis 42. Purge holes 56 may also be disposed annularly around common axis 42. Any number of purge holes 56 having any size may be disposed on end face 39. Purge holes 56 may fluidly connect cavity 50 with a region external to fuel injector 26, and may be configured to deliver cooling air into cavity 50. Perforations 46 may fluidly communicate enclosed cavity 50 with combustion chamber 28 to allow cooling air to exit into combustion chamber 28.

Cavity 50, along with the perforations 46, may function as an array of Helmholtz resonators 70 situated around central opening 52 of each fuel injector 26. This array of Helmholtz resonators 70 may eliminate or attenuate ("damp") screech that occurs due to instabilities generated during the combustion within combustion chamber 28. The size of cavity 50 and perforations 46 may be adjusted to damp screech of a particular frequency or a range of frequencies (damping frequency). Purge holes 56 may purge cavity 50 with cooling air to reduce temperature induced drift of the damping frequency.

Figure 6:
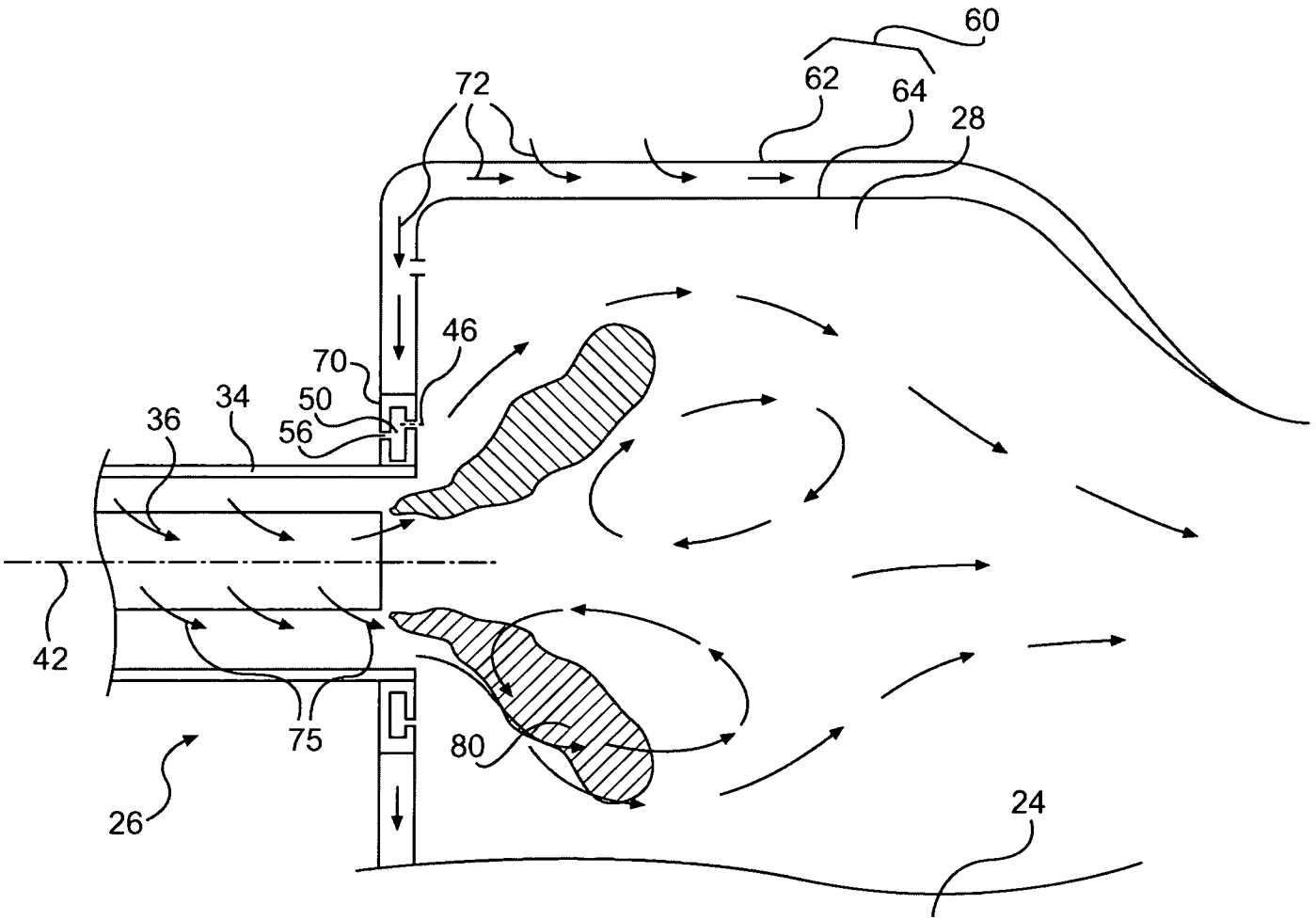
FIG. 6 is a schematic illustration of a combustion process performed by the turbine engine of FIG. 1.

FIG. 6 is a schematic illustration of combustion occurring within combustion chamber 28. Combustion chamber 28 may be annularly located about central shaft 24 and enclosed by an annular double skin liner 60. Double skin liner 60 may enclose a space between an inner skin 64 and an outer skin 62. A cooling air flow 72 may be maintained through the space between inner skin 64 and outer skin 62 to cool walls of combustion chamber 28. Combustion chamber 28 may receive a substantially homogenous mixture of fuel and air (fuel/air mixture 75) from each fuel injector 26. A swirling flow of the fuel/air mixture 75 from fuel injector 26 may set up a recirculating pattern within combustion chamber 28. The fuel/air mixture 75 may be ignited and fully combust within combustion chamber 28. As the fuel/air mixture 75 combusts, a heat release zone 80 may be formed near a mouth of fuel injector 26. A substantial portion of the energy from the combustion process may be released at heat release zone 80 to heat and expand gases within combustion chamber 28. These hot expanding gases may exit combustion chamber 28 and enter turbine section 16 (in FIG. 1).

The combustion process occurring within combustion chamber 28 may create instabilities manifested by pressure and acoustic oscillations (pressure waves). When the frequency of the oscillations couple with the acoustic mode of combustion chamber 28, the resulting structural vibrations may damage the turbine engine 10. The array of Helmholtz resonators 70 proximate to heat release zone 80 of combustion chamber 28 may help to damp oscillations occurring at a frequency close to the acoustic modes of combustion chamber 28.

INDUSTRIAL APPLICABILITY

The disclosed fuel injector with associated Helmholtz resonators may be applicable to any turbine engine where reduced vibrations within the turbine engine are desired. Although particularly useful for low NOx-emitting engines, the disclosed fuel injector may be applicable to any turbine engine regardless of the emission output of the engine. The disclosed fuel injector with the associated Helmholtz resonators may reduce vibrations by acoustically attenuating naturally-occurring pressure fluctuations within a combustion chamber of the turbine engine. The operation of a turbine engine fuel injector with Helmholtz resonators will now be explained.

During operation of turbine engine 10, air may be drawn into turbine engine 10 and compressed via compressor section 12 (See FIG. 1). This compressed air may then be directed into combustor section 14 through fuel injectors 26. As the compressed air flows through barrel housing 34 to combustion chamber 28, fuel may be injected and mixed with the compressed air (see FIG. 2). The fuel/air mixture 75 may then proceed to combustion chamber 28.

As the fuel/air mixture 75 enters combustion chamber 28, it may ignite and fully combust. Release of energy during the combustion process may heat combustion chamber 28 and the gases within it. A cooling air flow 72 may be maintained through the space between inner and outer skin 64, 62 to keep combustion chamber 28 walls cool. Purge holes 56 may also admit cooling air into cavity 50. The combustion process may cause the hot expanding exhaust gases to flow into turbine section 16 (see FIG. 1), where the energy of the combustion gases may be converted to rotational energy of turbine rotor blades and central shaft 24. The combustion process may also give rise to instabilities that cause pressure waves within combustion chamber 28. These pressure waves may be longitudinal waves that include successive regions of compressions (regions of high air pressure) and rarefactions (regions of low air pressure), and may result in screech. The pressure waves may propagate in all directions within combustion chamber 28 and may be reflected by inner skin 64 of double skin liner 60.

The pressure waves may also impinge on the array of Helmholtz resonators 70 formed at the end of fuel injector 26. When the compression region of a pressure wave impinges on fourth element 44*b* that forms a part of the resonator, a small quantity of air may be forced into cavity 50 through perforations 46 thereby, increasing the pressure inside. When the rarefied region of the pressure wave impinges the surface, the driving force that pushed the air into cavity 50 may have reduced, and the higher pressure air from inside cavity 50 may flow back into combustion chamber 28 through perforations 46. Due to the momentum of the air flowing out, this outflow may continue past the point of pressure equilibrium and cause a lower pressure within cavity 50. This pressure imbalance may draw air back into cavity 50, and the process may be repeated. Frictional and other losses during repeated inflow and outflow may gradually dissipate the energy of the pressure wave, thereby damping the pressure wave. The dimensions of cavity 50 and perforations 46 may be designed to damp a pressure wave having a range of frequencies close to an acoustic mode of combustion chamber 28. The array of Helmholtz resonators 70 may be modified to damp a pressure wave of a different frequency ("tuned") by varying the dimensions of chamber 50, the dimensions of perforations 46, and/or the number of perforations 46. In an application, fuel injector 26 with Helmholtz resonators 70 may be used alone, or in addition to conventional Helmholtz resonators formed on double skin liner 60, to attenuate screech.

Since tuning the array of Helmholtz resonators 70 of the present disclosure may only involve modifying end cap 44, such tuning may be accomplished quickly. The turbine engine down time, and the expenses involved in tuning the array of Helmholtz resonators 70, may also be lower since only end cap 44 may have to be replaced. Additionally, locating the array of Helmholtz resonators 70 at an exit of fuel injector 26 may position the resonators close to the energy source that is driving the instability, thereby increasing its effectiveness.

Since, fuel injector 26 with the array of Helmholtz resonators 70 may be used in addition to conventional resonators located within the walls of the combustion chamber, this configuration may increase the effectiveness of conventional screech elimination mechanisms. Additionally, since the array of Helmholtz resonators 70 may be out of the path of combustion chamber cooling air supply, the effectiveness of the resonators in attenuating screech may be higher. The resonators may also be tuned by changing the size of cavity 50 without significantly impacting cooling of combustion chamber 28.

It will be apparent to those skilled in the art that various modifications and variations can be made to the disclosed fuel injector. Other embodiments will be apparent to those skilled in the art from consideration of the specification and practice of the disclosed fuel injector. It is intended that the specification and examples be considered as exemplary only, with a true scope being indicated by the following claims and their equivalents.

What is claimed is:

1. A fuel injector for a turbine engine comprising:

a body member, including a pilot injector, extending along a longitudinal axis, the pilot injector being configured to direct a stream of fuel into a combustion chamber of the turbine engine;

a barrel member located radially outwards from the body member, to define an annular duct therebetween, the fuel injector being adapted to direct a stream of fuel air mixture, separate from the stream of fuel from the pilot injector, into the combustion chamber through the annular duct, the barrel member including an end face facing the combustion chamber; and an end cap coupled to the barrel member, wherein the end cap and the end face form an array of Helmholtz resonators.

2. The fuel injector of claim 1, wherein each resonator in the array of Helmholtz resonators includes a perforation exposed to the combustion chamber and an angular spacing between any two adjacent perforations is substantially the same.

3. The fuel injector of claim 2, wherein the angular spacing is between about 2 degrees and about 45 degrees.

4. The fuel injector of claim 2, wherein the longitudinal axis is substantially parallel to a central axis of each perforation.

5. The fuel injector of claim 2, wherein a diameter of each perforation is substantially the same and is between about 0.005 inches and about 0.5 inches.

6. The fuel injector of claim 2, wherein the array of Helmholtz resonators include an enclosed cavity fluidly communicating with the combustion chamber through the perforations.

7. The fuel injector of claim 6, wherein a cross sectional width of the cavity is between about 0.05 inches and about 0.5 inches and a cross sectional height of the cavity is between about 0.05 inches and about 1 inch.

8. The fuel injector of claim 6, wherein the end face includes one or more vent holes configured to admit air into the enclosed cavity.

9. The fuel injector of claim 1, wherein the end cap forms an annular ring around the longitudinal axis.

10. The fuel injector of claim 9, wherein an outer diameter of the end-cap is between about 1 inch and about 6 inches and an inner diameter of the end cap is between about 0.5 inches and about 5 inches.

11. A component for a fuel injector configured to direct a stream of fuel and a separate stream of fuel air mixture to a combustion chamber of a turbine engine, comprising:

a longitudinal axis;

a barrel member coupled to the combustion chamber and disposed radially outwards the longitudinal axis, the barrel member including an end face facing the combustion chamber; and an end cap coupled to the barrel member, wherein the end cap and the end face form an array of Helmholtz resonators, the array of Helmholtz resonators includes a plurality of perforations exposed to the combustion chamber, and each of the plurality of perforations includes a central axis substantially parallel to the longitudinal axis.

12. The component of claim 11, wherein the plurality of perforations are located in the end cap and the end face includes a second plurality of perforations, each of the second plurality of perforations having an axis substantially parallel to the central axis.

13. The component of claim 11, wherein the plurality of perforations are annularly located around the longitudinal axis and the angular spacing between any two adjacent perforations of the plurality of perforations is substantially a constant.

14. The component of claim 11, wherein each perforation of the plurality of perforations has a diameter between about 0.05 inches and about 0.06 inches.

15. A fuel injector configured to deliver a premixed fuel air mixture to a combustor of a gas turbine engine, comprising:

a central body formed around a common axis and containing a pilot injector, the pilot injector configured to inject a first stream of fuel out of a first axial end into the combustor;

a barrel housing positioned around the central body to form an annular mixing duct there between, the mixing duct being configured to mix a second stream of fuel and air therein to create the premixed fuel air mixture, and deliver the premixed fuel air mixture to the combustor through the first axial end without mixing with the first stream of fuel;

a ring-shaped end cap coupled to the barrel housing at the first axial end to form an array of Helmholtz resonators with a hollow cavity between the end cap and the barrel housing, the array of Helmholtz resonators being annularly positioned about the common axis; and, a plurality of perforations formed in the end cap and arranged in a radial pattern about the common axis, the perforations penetrating through the end cap to fluidly communicate the hollow cavity with the combustor, the perforations each defining an axis that is parallel to the common axis.

16. The fuel injector of claim 15 wherein the end cap is generally C-shaped in cross section and includes a third-element and a fifth element that are ring-shaped and revolved around the common axis with the third element being diametrically larger than and radially spaced from the fifth element, and a fourth element circumferentially spanning between and joining the third element and the fifth element, the plurality of perforations being formed through the fourth element.

17. The fuel injector of claim 16 wherein the barrel housing includes an end face at the first end, the end face comprising at least a second element that is ring-shaped and revolved around the common axis and extends axially away from the barrel housing, the second element being diametrically smaller than the fifth element of the end cap, the second element and the fifth element being joined together.

18. The fuel injector of claim 17 wherein the second element and the fifth element are brazed together.

19. The fuel injector of claim 17 wherein the end face further comprises a first element that extends radially outward from the barrel housing and is formed around the common axis and abuts the third element of the end cap, the first element and the second element of the end face making the end face L-shaped in cross section.

20. The fuel injector of claim 19, wherein the first element includes a plurality of purge holes formed there through, the purge holes being configured to permit compressed air from a compressor section of the gas turbine engine to enter the hollow cavity and eventually flow out into the combustor through the perforations.

21. The fuel injector of claim 15 wherein the perforations formed through the end cap are arranged in a single row circumferentially around the opening into the combustor, and the perforations are uniformly spaced from one another.

22. The fuel injector of claim 21, wherein each perforation of the plurality of perforations has a diameter between about 0.05 inches and about 0.06 inches.

23. The fuel injector of claim 21, wherein an angular spacing between two adjacent perforations of the plurality of perforations is between about 2 degrees and about 45 degrees.

* * * * *